US006189605B1

(12) United States Patent
Lameris

(10) Patent No.: US 6,189,605 B1
(45) Date of Patent: Feb. 20, 2001

(54) DEVICE AND METHOD FOR COOLING GAS

(75) Inventor: Herman Johannes Lameris, Hollandsche Rading (NL)

(73) Assignee: Standard Fasel-Lentjes B.V. (NL)

( * ) Notice: Under 35 U.S.C. 154(b), the term of this patent shall be extended for 0 days.

(21) Appl. No.: 09/236,813

(22) Filed: Jan. 25, 1999

(30) Foreign Application Priority Data

Jan. 26, 1998 (NL) ..... 1008124

(51) Int. Cl.[7] ..... F28D 7/02
(52) U.S. Cl. ..... 165/163; 165/920
(58) Field of Search ..... 165/140, 163, 165/920

(56) References Cited

U.S. PATENT DOCUMENTS

| | | | | |
|---|---|---|---|---|
| 2,508,247 | * | 5/1950 | Giaque | 165/163 |
| 3,812,825 | | 5/1974 | Polcer et al. | 122/34 |
| 4,466,479 | * | 8/1984 | MacLean | 165/177 |
| 4,687,052 | | 8/1987 | Fricker | 165/82 |
| 4,803,957 | | 2/1989 | Premel | 122/7 |
| 4,828,802 | * | 5/1989 | Colvert et al. | 422/144 |
| 4,998,583 | * | 3/1991 | Lahne et al. | 165/163 |
| 5,228,505 | * | 7/1993 | Dempsey | 165/140 |

FOREIGN PATENT DOCUMENTS

| | | | | |
|---|---|---|---|---|
| WO89/03723 | * | 5/1989 | (WO) | 165/140 |
| 8907022 | | 8/1989 | (WO) . | |

* cited by examiner

*Primary Examiner*—Allen Flanigan
(74) *Attorney, Agent, or Firm*—Ostrolenk. Faber, Gerb & Soffen, LLP

(57) ABSTRACT

Device for cooling fluid, comprising:

an inlet for infeed of the fluid;

a through-flow space through which the fluid flows;

a discharge for outfeed of the fluid; and a number of pipes containing coolant which extend helically in the interior of the through-flow space and the pitch of which is such that the upward angle at least equals the angle of fall of solid particles present in the fluid flow.

11 Claims, 1 Drawing Sheet

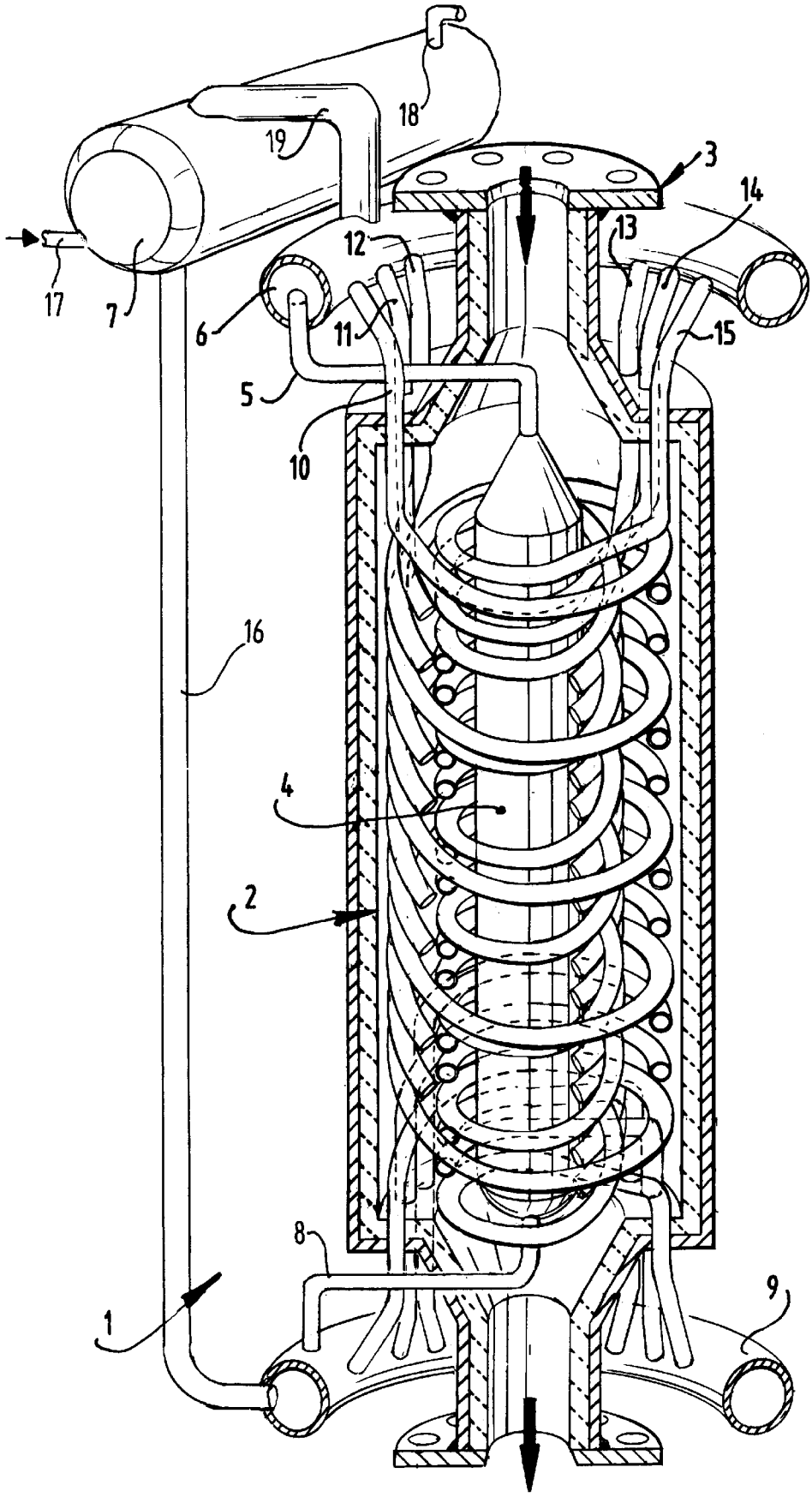
18
19
3
14
13
12
17
7
6
11
15
5
10
16
4
2
8
9
1

DEVICE AND METHOD FOR COOLING GAS

Particularly in the case of synthesis gas, which usually has a pressure in the range of 20–60 bar and a temperature in the range of 600–900° C., the rate of gas flow is too high to allow treatment in a typical cooling unit for flue gas. Since the quantity of solid particles such as dust and ash amounts to for instance more than 1% by weight, existing gas coolers can become clogged by fouling and the parts which come into contact with the gas erode and/or corrode easily.

The present invention provides a device for cooling fluid, comprising:

an inlet for infeed of the fluid;

a through-flow space through which the fluid flows;

a discharge for outfeed of the fluid; and a number of pipes which extend helically in the interior of the through-flow space and the pitch of which is such that the upward angle at least equals the angle of fall of solid particles present in the fluid flow.

Because of the upward angle of the helical round pipe the solid particles will not remain lying thereon and considerably less erosion, corrosion and/or clogging occurs. A saturated flow of steam can have a pressure higher than for instance 110 bar. The device is preferably designed such that the temperatures of the metal lie below 400° C., whereby carbon steel or slightly alloyed steel can be applied. For components which cannot be cooled sufficiently, it is recommended to use Cr (Chromium) and Ni (Nickel) alloys or heat-resistant linings on carbon steel.

The present invention further provides a method wherein the device according to the present invention is applied.

Further advantages, features and details of the present invention will be elucidated on the basis of the following description of a schematic preferred embodiment thereof with reference to the annexed figure.

A preferred embodiment 1 of a device according to the present invention comprises a substantially cylindrical vessel 2 provided at the top with a gas inlet channel for infeed of gas. In a preferred embodiment of the method wherein the device according to the present invention can be applied, the gas is for instance synthesis gas with a temperature in the range of 600–900° C. and a pressure in the range of 20–60 bar. In many cases the synthesis gas will have an amount of dust or ash particles in a quantity of about 1% by weight or more.

Preferably placed in vessel 2 is a central tube 4 which is connected to a a first annular conduit via a pipe 5. Central tube 4 is connected onto a second annular conduit 9 via a conduit 8 on the underside. Between steam drum 7 and annular conduit 9 is arranged a fall pipe through which water is carried into annular conduit 9. Steam drum 7 is provided with a water feed 17 and a steam discharge 18. For discharge of steam and water a connecting line 19 is arranged between annular conduit 6 and steam drum 7.

Disposed around central tube 4 in the present embodiment are two so-called packets of pipes running helically between the second annular conduit 9 and the first annular conduit 6. Each packet forms as it were a cylindrical casing; three pipes 10, 11 and 12 of the outer packet are shown in the figure, while three pipes 13, 14 and 15 of the inner packet are likewise shown.

In a first embodiment for practical realization there will most probably be three concentric casings of packets of pipes which will each comprise about ten windings and be connected to two or more annular conduits.

Coolant such as water and steam flows in pipes 10–15, preferably in counterflow to the direction A of the gas flow. The gas flow is urged through vessel 2 around central tube 4 and along the pipes with cooling medium. The pipes with cooling medium preferably extend at an angle of 45° or more so that dust and ash particles from the gas flow will not be left on the pipe of the heat exchanger. In order to prevent so-called bridge-formation between pipes, the inner pipes 13, 14 and 15 are preferably arranged in a helical direction opposite that of pipes 10, 11 and 12. The angle of 45° is the so-called angle of fall of such particles, i.e. at this angle the particles will roll or slide off the pipes.

The present invention is not limited to the above described preferred embodiment; the rights applied for are defined by the following claims, within the scope of which many modifications can be envisaged.

What is claimed is:

1. Device for cooling fluid, comprising:

an inlet for infeed of the fluid;

a through-flow space through which the fluid flows;

a discharge for outfeed of the fluid;

a number of pipes containing coolant which extend helically in the interior of the through-flow space and the pitch of which is at least 45° such that solid particles present in the fluid flow will roll or slide off the pipes:

first and second annular conduits for supplying the coolant to the pipes; and a central tube disposed within the through-flow space and connected to the first and second annular conduits.

2. Device as claimed in claim 1, wherein the angle of fall is in the order of magnitude of about 45°.

3. Device as claimed in claim 1 or 2, provided with a first number of helically formed pipes and a second and/or subsequent number of pipes wound concentrically therearound.

4. Device as claimed in claim 3, wherein the first pipe and the second and subsequent pipes are wound in each case in opposing direction.

5. Method for cooling fluid, wherein a device comprising an inlet for infeed of the fluid; a through-flow space through which the fluid flows; a discharge for outfeed of the fluid; a number of pipes containing coolant which extend helically in the interior of the through-flow space and the pitch of which is at least 45° such that solid particles present in the fluid flow will roll or slide off the pipes: first and second annular conduits for supplying the coolant to the pipes; and a central tube disposed within the through-flow space and connected to the first and second annular conduits is used, the method comnrising the steps of:

passing a fluid into the inlet in a first direction; and passing a coolant through the pipes and the central tube in a second direction opposite to the first direction.

6. The device of claim 1, wherein the coolant comprises water and steam.

7. The device of claim 1, wherein the fluid flows through the through-flow space in a downward direction along the central tube and around the pipes, and the coolant flows through the central tube and the pipes in a substantially opposite upward direction.

8. The device of claim 1, wherein the fluid is synthesis gas.

9. The device of claim 1, wherein the pipes comprise an outer packet of pipes, wound in a first helical direction, and an inner packet of pipes, wound in a second helical direction opposite the first helical direction.

10. The device of claim 9 wherein the outer packet of pipes and the inner packet of pipes each comprise three pipes.

11. The device of claim 9 wherein the packets of pipes are concentric.

* * * * *